US007997659B2

(12) United States Patent
Oertley et al.

(10) Patent No.: US 7,997,659 B2
(45) Date of Patent: Aug. 16, 2011

(54) ROTARY CUTTER FOR TUNNEL BORING MACHINE

(75) Inventors: Thomas E. Oertley, Peoria, IL (US); Gregory J. Kaufmann, Metamora, IL (US); Robert L. Meyer, Metamora, IL (US); Dennis R. Shookman, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 337 days.

(21) Appl. No.: 12/238,372

(22) Filed: Sep. 25, 2008

(65) Prior Publication Data

US 2009/0079256 A1 Mar. 26, 2009

(51) Int. Cl.
*E21B 10/00* (2006.01)

(52) U.S. Cl. ..... 299/106; 175/364

(58) Field of Classification Search ..... 299/79.1, 299/106, 110; 175/364
See application file for complete search history.

(56) References Cited

U.S. PATENT DOCUMENTS

| | | | | |
|---|---|---|---|---|
| 1,374,867 | A | 4/1921 | Wadsworth | |
| 1,768,577 | A * | 7/1930 | Dallerup | 175/364 |
| 2,086,486 | A | 7/1937 | Woods | |
| 3,216,513 | A | 11/1965 | Robbins et al. | |
| 3,612,196 | A | 10/1971 | Dixon | |
| 3,750,772 | A | 8/1973 | Venter | |
| 3,756,332 | A * | 9/1973 | Crane | 175/364 |
| 3,766,998 | A | 10/1973 | Bower, Jr. | |
| 3,787,101 | A | 1/1974 | Sugden | |
| 3,791,705 | A | 2/1974 | Schimel | |
| 3,835,944 | A | 9/1974 | Bingham | |
| 3,851,718 | A | 12/1974 | Fink | |
| 3,863,994 | A | 2/1975 | Fink | |
| 3,884,312 | A | 5/1975 | Williams | |
| 3,977,481 | A | 8/1976 | Fisk et al. | |
| 3,981,370 | A | 9/1976 | Bingham et al. | |
| 3,982,595 | A | 9/1976 | Ott | |
| 3,998,282 | A | 12/1976 | Robbins et al. | |
| 4,004,645 | A | 1/1977 | Rees et al. | |
| 4,202,418 | A | 5/1980 | Waddell | |
| 4,298,080 | A | 11/1981 | Hignett | |
| 4,359,114 | A | 11/1982 | Miller et al. | |
| 4,454,923 | A | 6/1984 | Tibussek | |
| 4,637,659 | A | 1/1987 | Tibussek | |
| 4,793,427 | A | 12/1988 | Lambson et al. | |
| 5,181,577 | A | 1/1993 | Tsukamoto et al. | |
| 5,234,064 | A | 8/1993 | Lenaburg | |
| 5,363,930 | A * | 11/1994 | Hern | 175/228 |
| 5,507,355 | A | 4/1996 | Mattsson | |
| 5,577,565 | A | 11/1996 | Kocab et al. | |
| 5,598,895 | A | 2/1997 | Anderson et al. | |
| 5,626,201 | A | 5/1997 | Friant et al. | |
| 5,785,135 | A | 7/1998 | Crawley | |
| 5,904,211 | A | 5/1999 | Friant et al. | |

(Continued)

FOREIGN PATENT DOCUMENTS

AU 485679 11/1976

(Continued)

*Primary Examiner* — John Kreck

(57) ABSTRACT

A rotary cutter for a tunnel boring machine or similar machine has a cutter ring mounted to a hub. The hub is mounted on a shaft. A sleeve bearing system is positioned between the hub and the shaft for supporting the hub on the shaft and allowing relative rotation. A duo-cone seal assembly is positioned between the hub and the shaft to seal out contaminants from the sleeve bearing system. An oil gallery with lubricating oil for lubricating the sleeve bearing system is provided in the shaft.

18 Claims, 3 Drawing Sheets

U.S. PATENT DOCUMENTS

| | | | |
|---|---|---|---|
| 5,961,185 | A | 10/1999 | Friant et al. |
| 6,131,676 | A | 10/2000 | Friant et al. |
| 6,367,569 | B1 | 4/2002 | Walk |
| 6,708,786 | B2 | 3/2004 | Cariveau et al. |
| 6,857,488 | B2 | 2/2005 | Pastor |

FOREIGN PATENT DOCUMENTS

| | | |
|---|---|---|
| EP | 1 503 032 | 12/2005 |
| SU | 1793036 | 2/1993 |
| WO | 9918326 | 4/1999 |

* cited by examiner 160b
110
300
200
310b
220
120
310a
130
131
112
220
310c
311c
30c
118

ROTARY CUTTER FOR TUNNEL BORING MACHINE

This application claims priority to U.S. Patent Application No. 60/974,982, filed Sep. 25, 2007, which is hereby incorporated by reference in its entirety.

TECHNICAL FIELD

The field of this disclosure is cutters for mining equipment. More specifically, the field is rotary cutters for tunnel boring machine heads.

BACKGROUND

Tunnel boring machines construct underground tunnels having a diameter ranging between a fraction of a meter up to several meters. The tunnel boring machine and its operating crew can perform several functions simultaneously to construct the tunnel, including boring, tailings material removal, lining, and installation of utilities into the tunnel such as fresh air conduits, power and water supply, etc.

The boring function of the typical tunnel boring machine is performed by a large rotating head provided at the forward end of the machine. The head rotates around an axis generally coaxial with the tunnel geometry. The rotating head gradually removes the material in the path of the machine at the face of the advancing tunnel. As the face of the tunnel is excavated and the debris removed, the tunnel length increases and the tunnel boring machine continuously advances to maintain the engagement of the head with the face. Cutters mounted to the rotating head perform the task of excavating the material from the face so that it can be collected and removed by the head and a conveyor system into aft portions of the machine for storage and/or transport out of the tunnel. The head advances and the cutters are pushed against the face typically under power from a system of hydraulic cylinders. Hydraulic cylinders are also deployed along with means which push against the sides of the tunnel in order to react the force of the cutters against the tunnel face.

Tunnel boring machine heads have utilized a variety of cutter styles. Fixed pick style cutters may be used in soft materials. In hard materials like hard rock, rotary cutters have typically been used. A number of rotary cutters are mounted in a pre-established pattern onto the head so that as the head rotates, a cutter is able to contact each portion of the face, engaging and removing material at a roughly equal rate across the area of the face. Rotary cutters employ a cutting ring mounted via a bearing onto a shaft. The shaft is in turn secured on the cutting head. As the head rotates, the cutting ring rotates on the shaft. The cutting ring is relatively sharp. As the ring pushes against the tunnel face with great compressive force, the rock adjacent the cutter ring is crushed and sheared and falls off of the face and is collected and removed as debris.

The service life of these rotary cutters can be a significant limitation in the operating efficiency of the tunnel boring machine. The cutters are pushed against the face with very significant forces including high shock loads and work in an abrasive, high wear environment. Thus, the cutter rings can be worn at a rapid rate. The cutter rings may be replaced after they are worn. But to change the cutter rings, the machine must be stopped for several hours while the cutters are removed and new cutter rings are installed. This time intensive re-ringing activity reduces the overall efficiency or rate of excavation of the machine.

Also, the bearing system between the cutter ring and the shaft can fail and require premature replacement of the entire cutter before the cutter rings have been worn. When the bearing system fails, the cutter ring stops turning. When the cutter ring stops turning, the portion of the cutter ring in contact with the face slides, the sliding contact wearing the cutter ring rapidly into a flat, wide spot which no longer has adequate compressive forces to crush the hard rock face.

One example of a typical rotary cutter design is seen in U.S. Pat. No. 4,793,427, ("the '427 patent") issued in 1988 to Boart International Limited. Other examples of cutter designs are found in U.S. Pat. No. 6,131,676 ("the '676 patent") issued in 2000 to Excavation Engineering Associates, Inc. Many different types and styles of rotary cutters, in addition to those in the '427 patent and the '676 patent, have been proposed and tested. But today the cutter remains one of the most important wear items on a tunnel boring machine and similar equipment, and constitutes an important limiting factor on the machine's excavation speed and efficiency.

DETAILED DESCRIPTION

Figure 1:
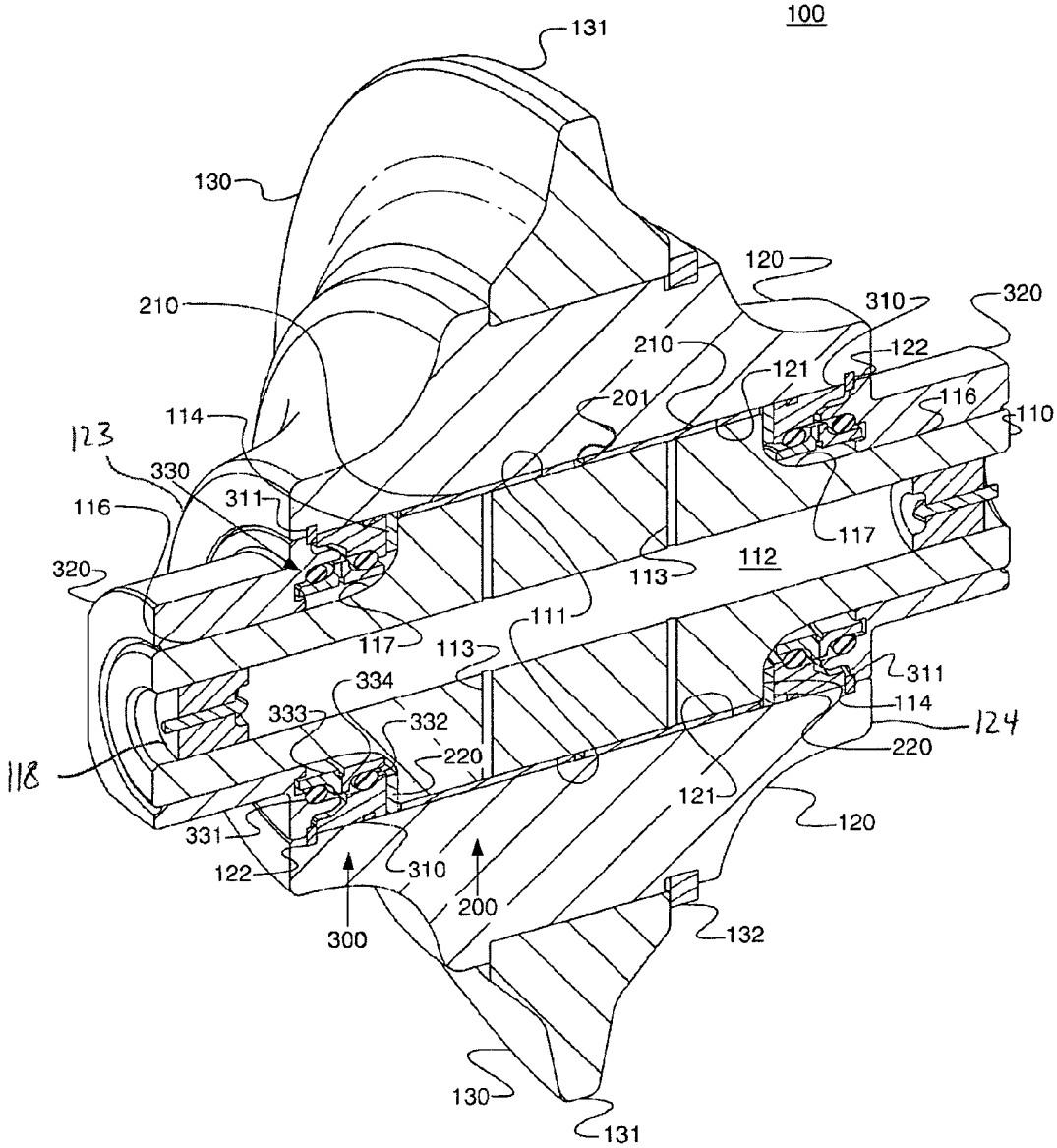
FIG. 1 is a cut away view of a first embodiment of a rotary cutter.

The following is a detailed description of exemplary embodiments of the invention. The exemplary embodiments described herein and illustrated in the drawing figures are intended to teach the principles of the invention, enabling those of ordinary skill in this art to make and use the invention in many different environments and for many different applications. The exemplary embodiments should not be considered as a limiting description of the scope of patent protection. The scope of patent protection shall be defined by the appended claims, and is intended to be broader than the specific exemplary embodiments described herein.

Many manufacturers use a tapered roller bearing as the bearing system between the cutting ring and the shaft. The '427 patent shows one example of a rotary cutter with a tapered roller bearing. The tapered roller bearing can withstand the high loads in the tunnel boring machine, including axial thrust loads. But tapered roller bearings are relatively bulky and take up a large portion of the available "envelope" of the cutter. For example, for a cutter which is overall 17 inches in diameter, the shaft and the tapered roller bearing system can take up a significant proportion of the 17 inch diameter, leaving only a small remainder of the diameter available for the cutter ring. The cutter ring comprises the wear material of the cutter, so in general, the larger the ring, the longer the life of the cutter. Because the tapered roller bearing takes up such a large portion of the space, the size of the cutter ring and the volume of wear material is limited, so the life expectancy of the cutter is limited.

On the other hand, in a particular tunnel boring machine head a 14 inch cutter might be optimal. In general, a smaller cutter head is able to apply a more concentrated point load on the rock face of the tunnel than a larger diameter cutter. So for a given amount of force available to push a head against the tunnel face, smaller cutters may excavate more efficiently because of their ability to concentrate the force. But because of the application of tapered roller bearings, it may be difficult to construct a 14 inch rotary cutter that can be pushed against the tunnel face with the same force as a 17 inch rotary cutter due to the constraints caused by the bearings. The use of tapered roller bearings might push the size of the cutter to 17 inches when 14 inches would be closer to ideal.

Others have proposed different bearing systems. For example, the '676 patent shows several different proposed designs for rotary cutters with different types of bearing systems. Yet, as mentioned previously, the cutter today remains one of the most important wear items on a tunnel boring machine and similar equipment despite the proposed improved designs in the '676 patent and other proposals, and constitutes an important limit on the machine's excavation speed and efficiency. Improvements to cutter designs that make them last longer, or allow them to apply greater forces to the tunnel face, can significantly improve the economics of excavating tunnels with a tunnel boring machine.

FIG. 1 illustrates a cutter assembly 100 with an improved cutter design according to a first embodiment. The cutter assembly 100 comprises a shaft 110, a hub 120, and a cutter ring 130. Shaft 110 is intended to be mounted to a head of a tunnel boring machine (not illustrated herein), or similar machine, as is known. The shaft 110 will be firmly fixed to the head, so that forces from the cutter ring are transferred back through the hub 120, to the shaft 110, and in turn to the head. The shaft 110 extends away from both sides of the cutter assembly 100 to allow each end thereof to be mounted in a cradle on the cutter head (not shown). Mounting and supporting each end of the shaft minimizes the amount of bending deflection under a given load compared to a cantilever mounting arrangement.

Hub 120 is mounted on shaft 110 to be rotatable. A bearing system 200 and seal system 300 help mount hub 120 on shaft 110.

Cutter ring 130 includes a relatively sharp, circumferential cutting edge 131 that contacts a rock face for crushing and excavating the rock. Cutter ring 130 may be mounted to the hub 120 via a retaining ring 132 in a standard known fashion. Cutter ring 130 is centrally positioned on hub 120 between a first end 123 and an opposite second end 124 of hub 120.

Bearing system 200 comprises a sleeve bearing instead of a tapered roller bearing as has commonly been used in the past on rotary cutters. The sleeve bearing system is much more compact than the tapered roller bearing. The use of a sleeve bearing system permits the hub 120 and cutter ring 130 to occupy a proportionally larger portion of the total envelope or volume of the cutter assembly 100. A larger cutter ring 130 may permit the cutter assembly 100 to last longer in operation, minimizing the number of ring changes that are needed, and increasing the overall efficiency or excavation speed of the tunnel boring machine. Substituting a sleeve bearing for a tapered roller bearing also presents advantages in assembly as the tapered roller bearing typically requires precise operations during assembly to preload. The sleeve bearing does not require steps to preload.

Bearing system 200 and seal system 300 generally comprise sets of identical, mirror image components arranged alternately on the right and left side of the cutter assembly 100. For convenience in this specification, only one side of each system will be described when there is a pair of substantially identical, mirror image components. When there is a pair of substantially identical, mirror image components they will be referred to with only a single reference number.

The sleeve bearing system comprises a pair of steel-backed, bronze sleeve bearings 210. Each of the sleeve bearings 210 is mounted to the inside of a through bore 121 formed in the hub 120. Bore 121 extends from the first end 123 to the second end 124 of hub 120. The sleeve bearings 210 may be roller or ball burnished to the inside of bore 121 during assembly in order to hold them in place. The roller or ball burnishing may also impart beneficial residual stresses on the surface of bearings 210. The steel backing of sleeve bearing 210 is in contact with the bore 121 of hub 120. An annular space 201 may be left between the sleeve bearings 210. A bearing surface 111 formed on the center of shaft 110 rides against the bronze side of the sleeve bearings 210. An oil gallery 112 is formed in an axial bore inside of shaft 110 for holding lube oil to lubricate the bearings 210. One or more plug assemblies 118 may be used to create the oil gallery 112 in the axial bore in shaft 110 and allow for filling the gallery 112 with lube oil after the cutter assembly 100 has been assembled. One or more oil passageways 113 may lead from the oil gallery 112 to the bearing surface 111 to circulate oil around the bearings 210.

A pair of thrust washers 220 react the axial thrust loads. A pair of axial thrust surfaces on shoulders 114 are formed on the shaft 110 adjacent to bearing surface 111 to ride against the thrust washers 220. The other side of thrust washers 220 bears against a pair of retainers 310. Each retainer 310 is in turn held in place inside of bore 121 with a retaining ring 311 fit in grooves 122 formed on bore 121.

Seal system 300 includes a duo-cone seal group to seal lubricating oil inside of cutter assembly 100, and keep debris out. Collars 320 may be mounted to the shaft 110 around a pair of smaller diameter portions 116 thereof. Collar 320 may be mounted around the portion 116 of shaft 110 with a non-circular cross-section, such that the collar 320 is assured to not rotate relative to shaft 110. Or, alternatively collar 320 may be press fit onto the smaller diameter portion 116 of shaft 110, and may also be provided with a cross-pin or other known hardware to ensure that in operation the collar 320 does not rotate relative to the shaft 110. Collar 320 may also have a non-circular exterior surface for mounting in a cradle on the cutter head, as is known. Collar 320 supports resilient toric element 331 and retainer 310 supports resilient toric element 332 of a duo-cone seal group 330. Each toric element 331, 332 in turn biases a rigid seal 333 and 334, respectively. Rigid seals 333, 334 are in contact with one another and arranged for relative rotation therebetween, while maintaining a seal to keep out contaminants. Seal 333 and toric 331 do not rotate and are stationary with respect to shaft 110 and collar 320. Seal 334 and toric 332 rotate along with retainer 310, hub 120, and cutter ring 130.

The duo-cone seal groups 330 are located around the reduced diameter portions 116 of shaft 110 so that the toric and seal elements are spaced from the center of shaft 110 a radial distance that is smaller than the radial spacing of sleeve bearings 210. With duo-cone seal assemblies spaced close to the center of shaft 110, the relative speed or rotation of seals 333 and 334 against one another is minimized. If seals 333 and 334 were placed at the same or greater radial distance from the center of shaft 110 as the sleeve bearings 210, then their relative speed to one another would increase. Greater speeds result in higher temperatures. This arrangement helps minimizes the relative speed and in turn the temperature of duo-cone seal groups 330 which contributes to maximizing their lives. The resilient toric elements 331, 332 in particular are sensitive to heat and their temperature should be kept below a maximum temperature for them to function properly. The resilient toric elements 331, 332 should operate properly in order to ensure that very little dirt penetrates through the seal system 300 into the bearing system 200. Having a large reservoir 112 of lube oil also helps to reduce the lube oil temperature during operation, which in turn helps maintain the temperature of components in the seal system 300 and bearing system 200 below maximum levels.

As the shaft 110 and other components flex in operation, there may be a pressure differential of the oil immediately surrounding the seal system 300 components on each side of the cutter assembly 100. If the pressure differential rises too high, the oil can squirt out of the seal system 300, or a relatively low pressure can draw material through the seal system 300 from outside the cutter assembly 100. To help prevent this possibility, the shaft 110 may be manufactured with a longitudinal flat (in the direction of the rotational axis of shaft 110) to help oil move from one side of cutter assembly 100 to the other, opposite side to relieve oil pressure differentials.

A transition radius area 117 of shaft 110 is formed in the transition between the large diameter bearing surface 111 and the small diameter portion 116. The transition radius area 117 can experience significant stress in operation. Transition radius area 117 can be roller or ball burnished to impart residual compressive stresses therein during manufacturing. The residual compressive stresses may be helpful in maintaining a necessary fatigue life for shaft 110 by preventing the formation and propagation of cracks in this potentially critical area along the surface of shaft 110.

Even loading of sleeve bearings 210 during use of cutter assembly 100 is important. Provision of two sleeve bearings 210, instead of a single large sleeve bearing, may contribute to achieving even loading. When force is applied against the cutter ring 130, a corresponding force is applied against the center of shaft 110. Shaft 110 will bend about its center point and bow, and each sleeve bearing 210 can move separately. Also, the shaft can be crowned so that its center diameter is slightly more than the diameter and the outer edges of bearing surface 111. With this crowning, when shaft 110 bows under force of the cutting ring 130, the side of shaft 110 nearest the applied force will remain approximately flat all the way across bearing surface 111, allowing for more even loading of the sleeve bearings 210.

Figure 2:
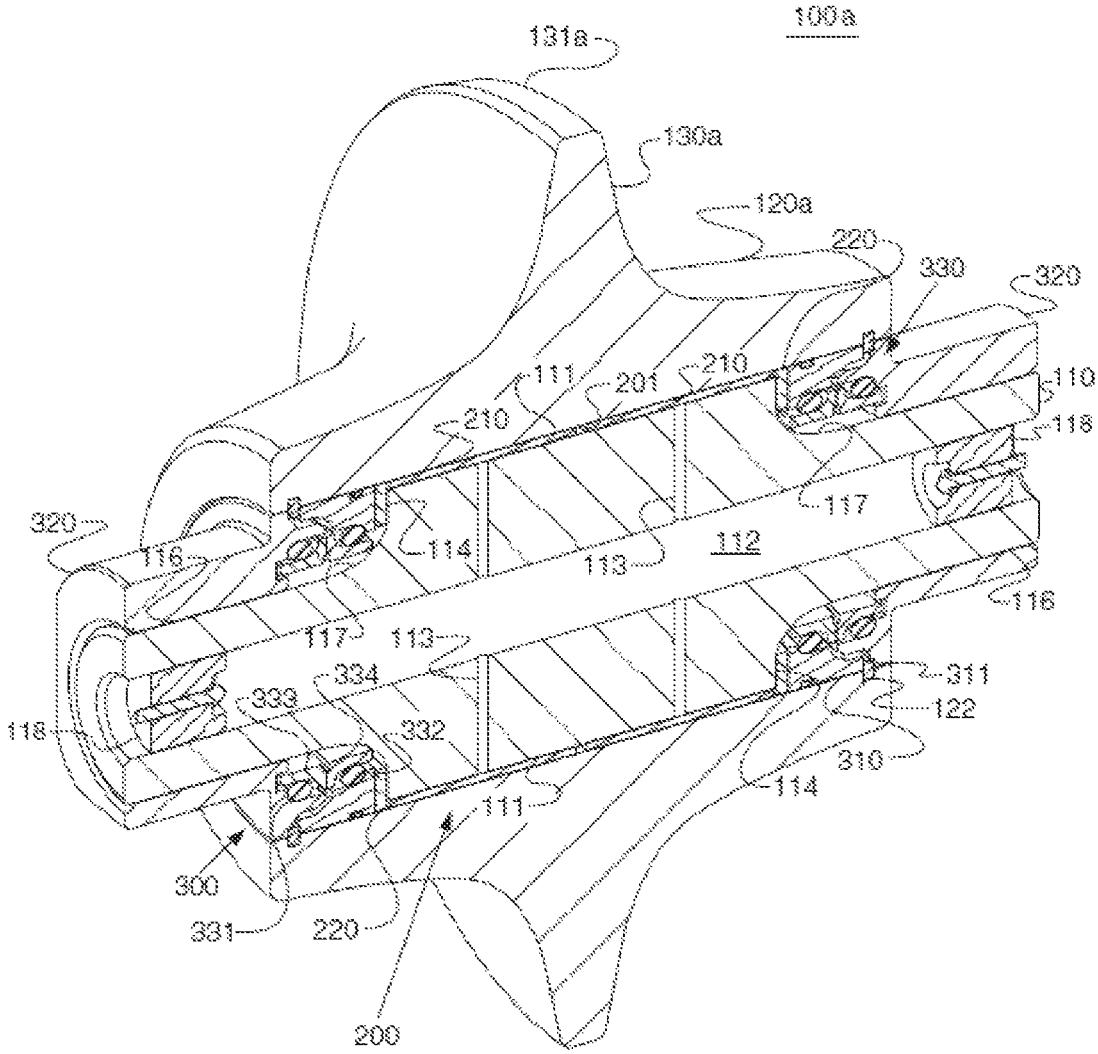
FIG. 2 is a cut away view of a second embodiment of a rotary cutter.

FIG. 2 shows an embodiment of a cutter assembly 100*a* similar to that shown in FIG. 1, except in place of hub 120 is hub 120*a*. The hub 120*a* is formed with an integral cutter ring 130*a* and circumferential cutting edge 131*a*. The integral hub 120*a* and cutter ring 130*a* may present some advantages over the two-piece design in FIG. 1. For example, the integral design may allow for greater strength, increasing the ability to minimize the overall size of the cutter assembly 100*a* which, as previously described, will result in a cutter assembly 100*a* of lesser diameter which may be able to apply greater, more concentrated forces to the tunnel face. The design of FIG. 2 may result in a cutter assembly 100*a* having an overall cutter ring diameter of 14 inches, which is still able to apply the same load to the tunnel face as a traditional 17 inch cutter can today.

Figure 3:
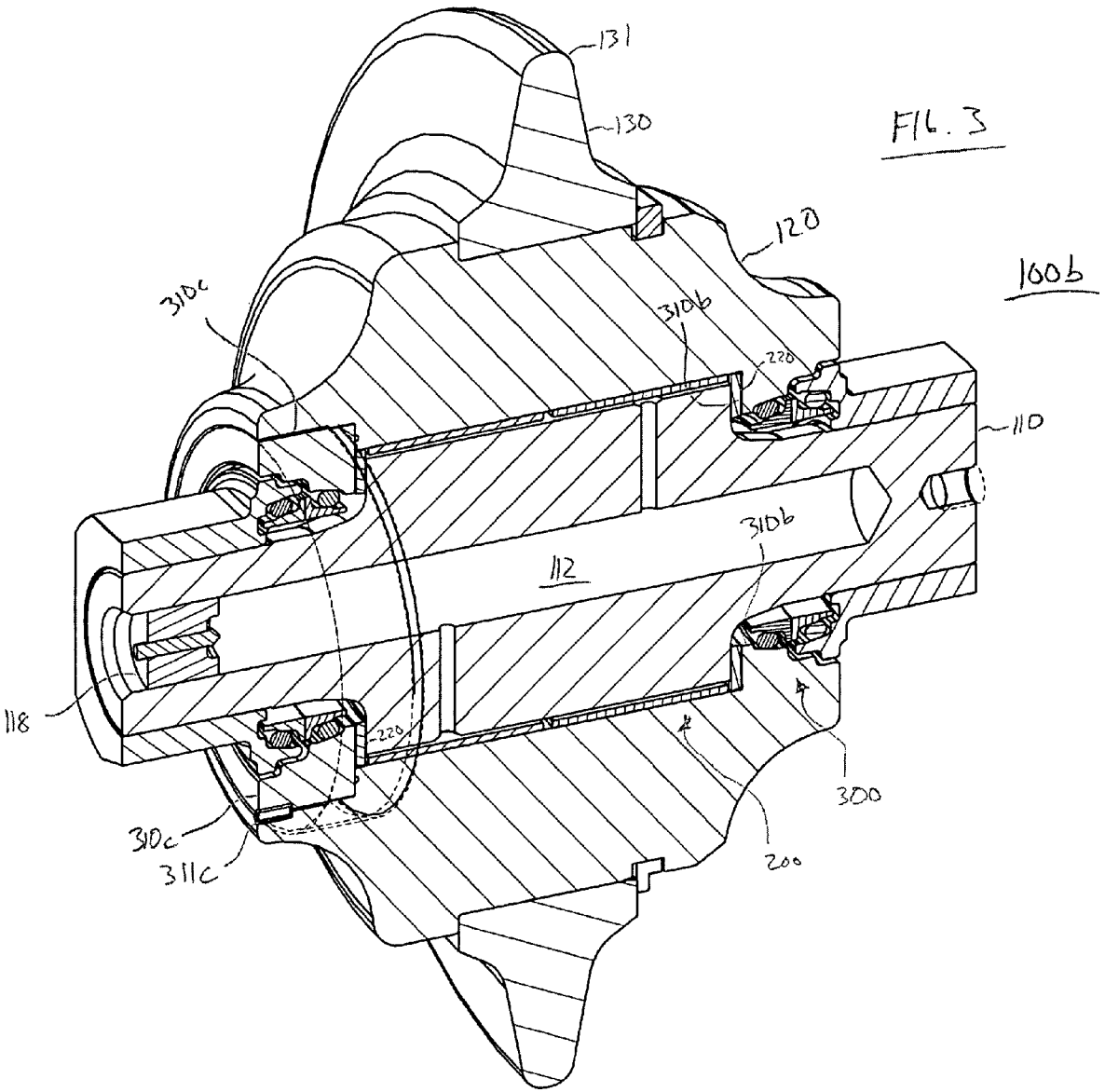
FIG. 3 is a cut away view of a third embodiment of a rotary cutter.

FIG. 3 illustrates another embodiment of cutter assembly 100*b*. In particular, the difference between cutter assembly 100 in FIG. 1 and cutter assembly 100*b* in FIG. 3 is in the design of the retainers 310 that support the thrust washers 220. In the end of the shaft on the right side of FIG. 3, a retainer 310*b* has been integrally formed with hub 120. Integrally forming retainer 310*b* with the hub 120 obviates the need for retaining ring 311 and groove 122, which may be potential stress points if they are present. On the left side of cutter assembly 100*b* is a retainer 310*c*. Retainer 310*c* is mounted to the hub 120 via mutually formed threads. Again, the threads obviate the need for retaining ring 311 and groove 122, which may be potential stress points. A retaining pin 311*c* may be used between retainer 310*c* and hub 120 to prevent the two from relative rotation after assembly.

INDUSTRIAL APPLICABILITY

The cutter assemblies 100, 10*b*, and 100*c* have industrial applicability on tunnel boring machines and other machines where they can be used to crush and remove rock in the construction of wells, tunnels, or other underground structures.

We claim:

1. A rotary cutter comprising:

a hub with a cutter ring integrally formed with or mounted to the hub, the cutter ring circumferentially surrounding the hub and centrally positioned between a first end and an opposite second end of the hub, the hub having a longitudinal, through first bore formed therein which extends between the first end and the second end;

a shaft positioned inside the first bore, the shaft extending from each end of the bore whereby the shaft may be supported at both ends by a mounting arrangement on a cutter head, the shaft having a large diameter bearing surface and a small diameter portion, wherein the large diameter bearing surface and the small diameter portion are connected by a transition radius area;

a sleeve bearing positioned in the first bore between the shaft and the hub; and at least one seal group positioned between at least one of the small diameter portion and the hub and the transition radius area and the hub.

2. A rotary cutter according to claim 1 further comprising an oil gallery for holding lubricating oil formed inside the shaft, and an oil passageway formed between the oil gallery and the sleeve bearing.

3. A rotary cutter according to claim 2 further comprising a pair of duo-cone seal groups positioned between the shaft and the hub to prevent contaminants from contaminating the sleeve bearing.

4. A rotary cutter according to claim 3 wherein the duo-cone seal groups each comprise a pair of resilient toric elements, and a pair of rigid seal elements in contact with one another and arranged for relative rotation therebetween, where each resilient toric element biases against a rigid seal element.

5. A rotary cutter according to claim 4 further comprising a pair of retainers rigidly fixed to or integrally formed with the hub, each retainer bearing against a thrust washer which in turn bears against a shoulder formed on the shaft to react axial thrust loads.

6. A rotary cutter according to claim 5 wherein each resilient toric element also biases against a retainer.

7. A rotary cutter according to claim 2 further comprising a plug assembly positioned in an axial bore formed in the shaft, the plug assembly preventing lube oil from leaking out of the oil gallery and permitting the oil gallery to be filled with lube oil.

8. A rotary cutter comprising:

a hub with a cutter ring integrally formed with or mounted to the hub, the cutter ring circumferentially surrounding the hub, the hub having a longitudinal, through first bore formed therein which extends between a first end and an opposite second end of the hub;

a shaft positioned inside the first bore;

a first sleeve bearing positioned in the first bore between the shaft and the hub; and a pair of duo-cone seal groups positioned between the shaft and the hub to prevent contaminants from contaminating the sleeve bearing wherein the diameter of each duo-cone seal group is less than the diameter of the first sleeve bearing.

9. A rotary cutter according to claim 8 wherein a first duo-cone seal group is positioned inside the first bore near the first end of the hub and a second duo-cone seal group is positioned inside the first bore near the second end of the hub.

10. A rotary cutter according to claim 9 further comprising a second sleeve bearing positioned in the first bore between the shaft and the hub.

11. A rotary cutter according to claim 10 further comprising an oil gallery for holding lubricating oil formed inside the shaft, and an oil passageway formed between the oil gallery and the first sleeve bearing.

12. A rotary cutter according to claim 11 further comprising a plug assembly positioned in an axial bore formed in the shaft, the plug assembly preventing lube oil from leaking out of the oil gallery and permitting the oil gallery to be filled with lube oil.

13. A rotary cutter according to claim 8 further comprising a pair of retainers rigidly fixed to or integrally formed with the hub, each retainer bearing against a thrust washer which in turn bears against a shoulder formed on the shaft to react axial thrust loads.

14. A rotary cutter comprising:

a hub with a cutter ring integrally formed with or mounted to the hub, the cutter ring circumferentially surrounding the hub, the hub having a longitudinal, through first bore formed therein which extends between a first end and an opposite second end of the hub;

a shaft positioned inside the first bore;

a first sleeve bearing positioned in the first bore between the shaft and the hub;

a pair of duo-cone seal groups positioned between the shaft and the hub to prevent contaminants from contaminating the sleeve bearing wherein a diameter of each duo-cone seal group is less than a diameter of the first sleeve bearing; and an oil gallery for holding lubricating oil formed inside the shaft, and an oil passageway formed between the oil gallery and the first sleeve bearing.

15. A rotary cutter according to claim 14 further comprising a second sleeve bearing positioned in the first bore between the shaft and the hub.

16. A rotary cutter according to claim 14 further comprising a pair of retainers rigidly fixed to or integrally formed with the hub, each retainer bearing against a thrust washer which in turn bears against a shoulder formed on the shaft to react axial thrust loads.

17. The rotary cutter of claim 1, wherein the at least one seal group radially extends to a distance which is less than the diameter of the large diameter bearing surface.

18. The rotary cutter of claim 1, wherein the shaft is crowned such that a diameter of a central portion of the shaft is greater than a diameter of a remaining portion of the shaft.

* * * * *